US005210459A

United States Patent [19]

Lee

[11] Patent Number: 5,210,459

[45] Date of Patent: May 11, 1993

[54] SHADOW MASK STRUCTURE OF A COLOR CATHODE RAY TUBE

[75] Inventor: Ok-taek Lee, Anyang, Rep. of Korea

[73] Assignee: Samsung Electron Devices Co., Ltd., Kyunggi, Rep. of Korea

[21] Appl. No.: 782,553

[22] Filed: Oct. 25, 1991

[30] Foreign Application Priority Data

Oct. 27, 1990 [KR] Rep. of Korea ..... 90-17283

[51] Int. Cl.[5] ..... H01J 29/07

[52] U.S. Cl. ..... 313/406; 313/402; 313/404; 313/407

[58] Field of Search ..... 313/402, 404, 405, 406, 313/407, 408

[56] References Cited

U.S. PATENT DOCUMENTS

| | | | |
|---|---|---|---|
| 3,890,526 | 6/1975 | Palac | 313/408 |
| 4,358,702 | 11/1982 | Gijrath et al. | 313/406 X |
| 4,638,211 | 1/1987 | Fonda | 313/407 X |
| 4,644,222 | 2/1987 | Brunn | 313/402 X |
| 4,652,792 | 3/1987 | Tokita et al. | 313/404 X |
| 4,827,178 | 5/1989 | Higashinakagawa et al. | 313/407 X |
| 4,891,546 | 1/1990 | Dougherty et al. | 313/402 X |
| 5,063,325 | 11/1991 | Ragland, Jr. | 313/407 X |

FOREIGN PATENT DOCUMENTS

| | | | |
|---|---|---|---|
| 0240077 | 10/1987 | European Pat. Off. | 313/406 |

*Primary Examiner*—Donald J. Yusko
*Assistant Examiner*—Ashok Patel
*Attorney, Agent, or Firm*—Leydig, Voit & Mayer

[57] ABSTRACT

A cathode ray tube with a shadow mask, the shadow mask structure being suspended and fixed behind the panel of the cathode ray tube. Plate springs for connecting the shadow mask structure and the panel are placed to apply pulling forces at either the sides or the corners of the shadow mask frame, so as to firmly hold the shadow mask to the skirt without deforming the shadow mask.

8 Claims, 7 Drawing Sheets

SHADOW MASK STRUCTURE OF A COLOR CATHODE RAY TUBE

FIELD OF THE INVENTION

The present invention relates to a color cathode ray tube with a shadow mask structure.

BACKGROUND OF THE INVENTION

The structure and the method for suspending a shadow mask inside a color cathode ray tube has been improving with new designs of large color cathode tubes. The examples of such improvements include the structures which are revealed in U.S. Pat. No. 3,890,526 to Palac, U.S. Pat. No. 4,358,702 to Gijrath et al., and U.S. Pat. No. 4,652,792 to Tokida.

Gijrath et al.'s shadow mask support on panel 10 having skirt 11 is illustrated in FIG. 1. In the structure, shadow mask structure 20*a* is suspended via four plate springs 21*a*. Plate spring 21*a* is welded to peg 22*a* and to shadow mask structure 20*a*. The locations of plate springs 21*a* are at the four corners (or vertices) of shadow mask structure 20*a*. It is noted that FIG. 1 shows only one corner of the structure.

FIG. 2 illustrates Palac's device. Shadow mask structure 20*b* is mounted on face plate 10*b* via four U-shaped plate springs 21*b*. Each of pegs 22*b* is affixed to studs 12*b* having an opening 13*b* and plate spring 21*b*.

Tokida's shadow mask support structure is shown in FIG. 3. Shadow mask 202C is held by elastic biases 21C, one plate of which is welded to the shadow mask frame 201 C and the other plate of which is engaged with stud 12C.

In each of the above inventions, the structures which function as springs are placed so that they exert forces which compress each of the shadow masks inwards, as shown by the direction of the arrows in FIGS. 1–3. The compression forces are necessary to hold the shadow masks from excessively moving or vibrating; however, the compression forces also tend to distort or to deform the shadow mask or frame. Such distortions ultimately cause incorrect landing of electron beams on the masks, resulting in images with poor color.

SUMMARY OF THE INVENTION

It is the object of the present invention to provide a color cathode-ray tube having a shadow mask with an improved suspending structure, to prevent an abnormal deformation of the shadow mask, and to reduce the deterioration of color quality of images produced on the shadow mask.

According to the present invention, the color cathoderay tube comprises:

an electron gun;

a funnel having a neck in which the electron gun is placed;

a panel being connected with the funnel to form a tubular sphere and having a screen on the inner surface thereof; and a shadow mask structure located inside the tubular sphere, the shadow mask structure being at the back of the panel, the shadow mask structure comprising a number of supports for indirectly supporting the shadow mask structure, each support being attached to the panel, a shadow mask, and a number of elastic bias for connecting the shadow mask to the supports, each elastic bias being attached to the shadow mask, each elastic bias being connected to one of the supports, the elastic biases being placed to apply stretching forces on the shadow mask.

BRIEF DESCRIPTION OF THE DRAWINGS

The above and other objects and advantages of this invention will become more apparent and more readily appreciated from the following detailed description of the presently preferred exemplary embodiment of the invention, taken in conjunction with the accompanying drawings, of which.

DETAILED DESCRIPTION OF AN EMBODIMENT OF THE PRESENT INVENTION

Figure 1:
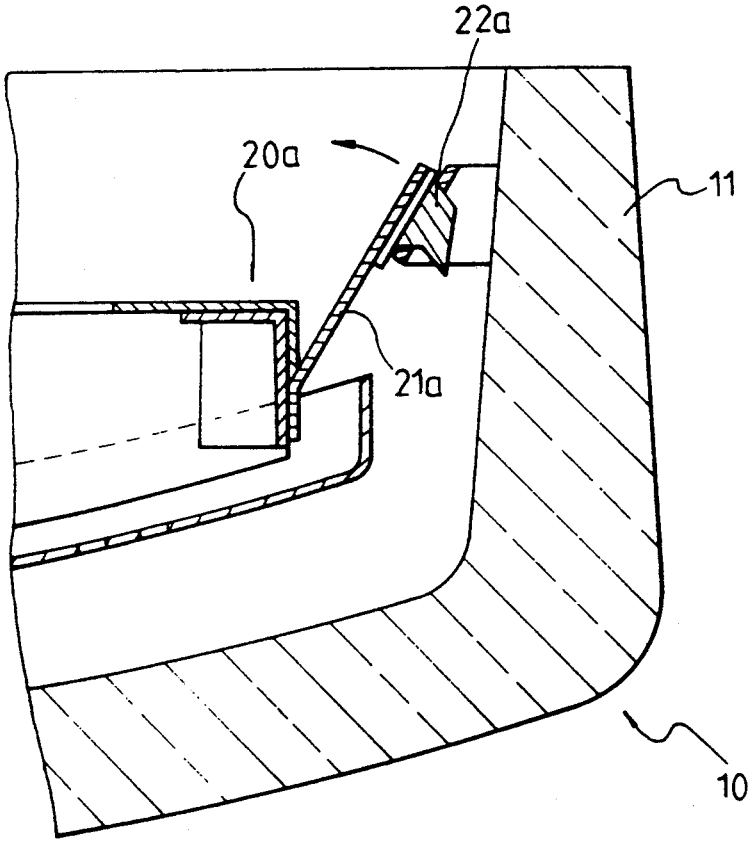
FIG. 1 (PRIOR ART)
FIGS. 1–3 are partial schematic, cross-sectional views of conventional shadow mask supporting structures of color cathode-ray tubes.
Figure 2:
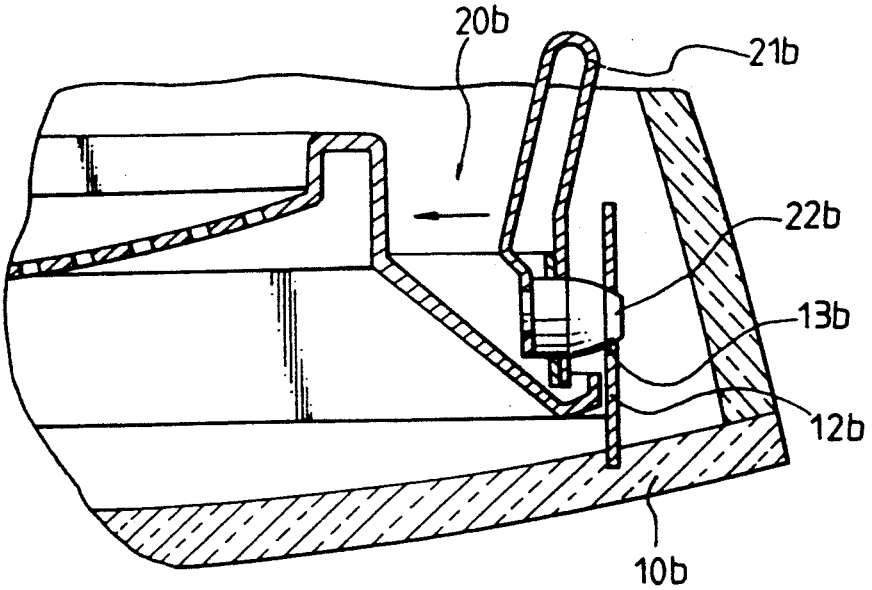
FIG. 2 (PRIOR ART)
Figure 3:
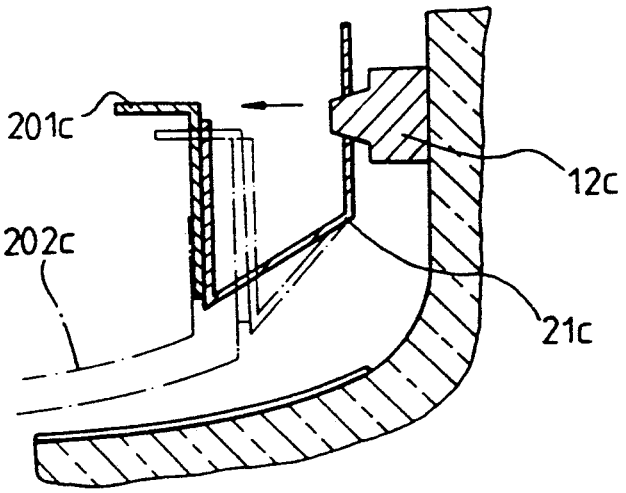
FIG. 3 (PRIOR ART)
Figure 4:
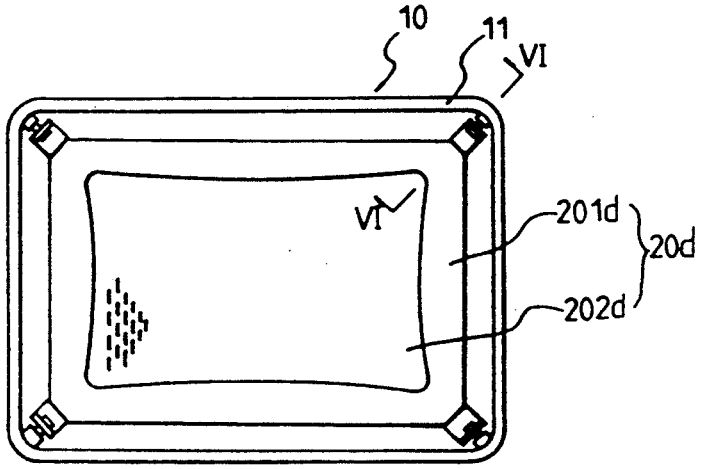
FIG. 4 is a schematic, cross-sectional view of a shadow mask supporting structure according to the first embodiment of the present invention.

FIG. 4 shows a front, cross-sectional view of a shadow mask supporting structure according to the first embodiment of the present invention. At the four corners of the shadow mask structure 20*d*, with shadow mask 202*d* centered on frame 201*d*, are elastic bias means. Like parts are indicated by the same reference numerals as those used in other figures throughout the specification.

Figure 6:
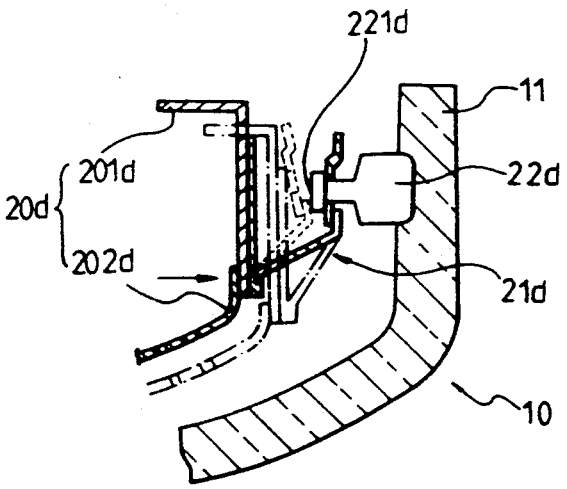
FIG. 6 is a partial, schematic, cross-sectional view of the shadow mask supporting structure along the line VI—VI in FIG. 4.
Figure 5:
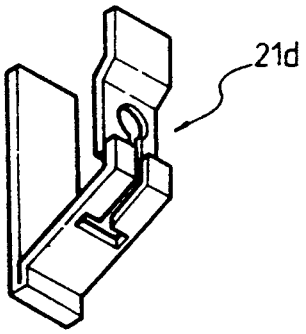
FIG. 5 is a perspective view of a first embodiment of a plate spring according to the present invention.

The composition of the elastic bias means is shown in FIGS. 5 and 6. Each of four plate springs 21*d* is attached to a corner of frame 201*d*. It is noted that frame 201*d* holds shadow mask 202*d*. Each plate spring 21*d* is hooked to head 221*d* of stud 22*d*, which in turn is fixedly attached to skirt 11. Here it is noted that the plate springs 21*d* are placed so that they exert forces which stretch the shadow mask outwardly, as shown by the direction of the arrow in FIG. 6.

Figure 7:
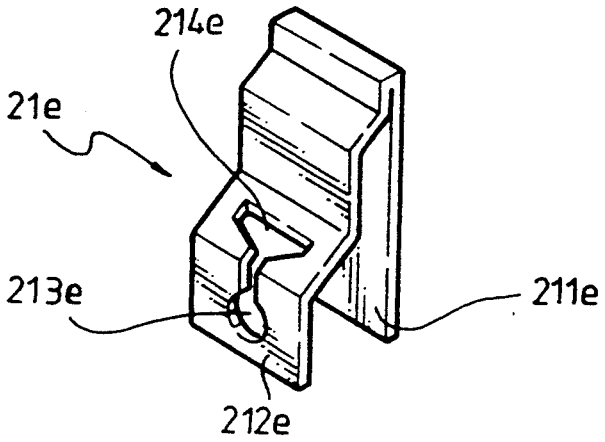
FIG. 7 is a perspective view of a second embodiment of a plate spring according to the present invention.
Figure 8:
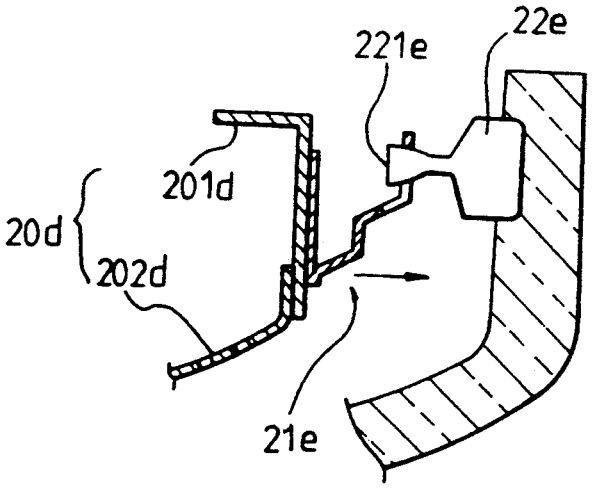
FIG. 8 is a partial schematic, cross-sectional view of the shadow mask supporting structure shown in FIG. 7, when assembled with other parts.

Another plate spring 21*e* is shown in FIGS. 7 and 8. Welding face 211*e* and locking face 212*e* form a flexible structure about a single joint. To hold spring 21*e* in its place, head 221*e* (FIG. 8) is slotted into locking hole 213*e* 00 via slot 214*e*, the locking hole's diameter is slightly larger than the neck portion of stud 22*e*.

When desired, head 221*e* may be locked into position as shown in FIG. 8 by first holding the plate spring so that it is forcibly stretched toward the head 221*e*, and then inserting head 221*e* into slot 214*e* and pulling down and releasing the plate spring so that the head 221*e* is locked in the locking hole 213*e* completing the locking process. The shape of head 221*e* is as shown in FIG. 8.

Figure 9:
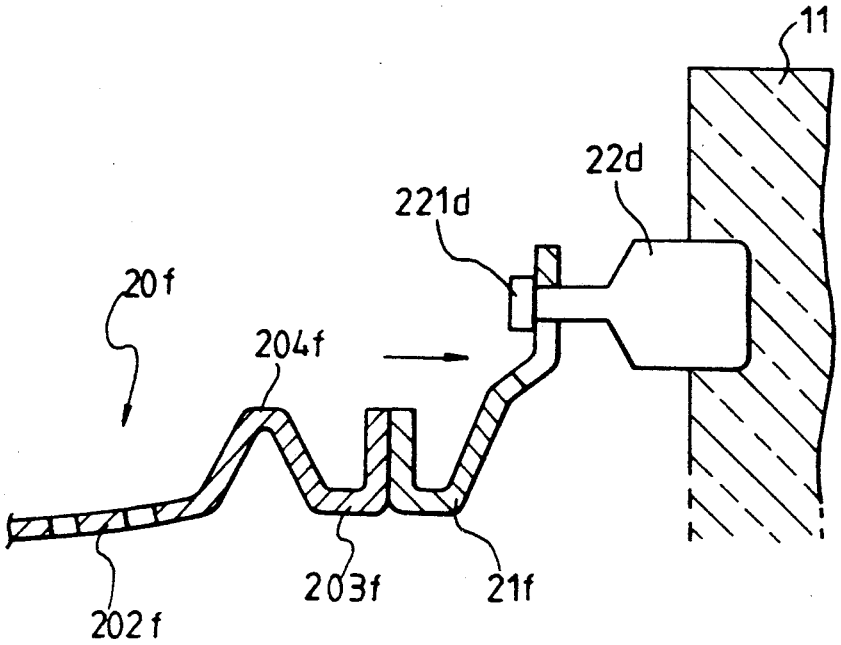
FIG. 9 is a partial, schematic, cross-sectional view of the shadow mask supporting structure according to another embodiment of the present invention, wherein it is applied to frameless shadow mask structure.

FIG. 9 illustrates another embodiment of the present invention. Shadow mask 202*f* is located in the center of the whole shadow mask structure 20*f* locking a shadow mask frame. Near the edge of shadow mask 202*f*, rib 204*f* is provided. Rib 204*f* serves as a frame in the ordinary shadow mask structure.

Plate spring 21*f* shown in FIG. 9 is slightly different from plate spring 21*e* in FIG. 7 and 8. Welding face 211*e* of plate spring 21*e* in FIG. 7 is larger than that of plate spring 21*f* in FIG. 9. It is observed that stud 22*d* in FIG. 9 is also different from stud 22*e* in FIG. 8 but the same as that in FIG. 6. Head 221*d* of stud 22*d* in FIG. 9 is shaped like a block when viewed from the side. Head 221*e* of stud 22*e* FIG. 8 has the shape of a cone, with bevelled top and bottom.

Figure 10:
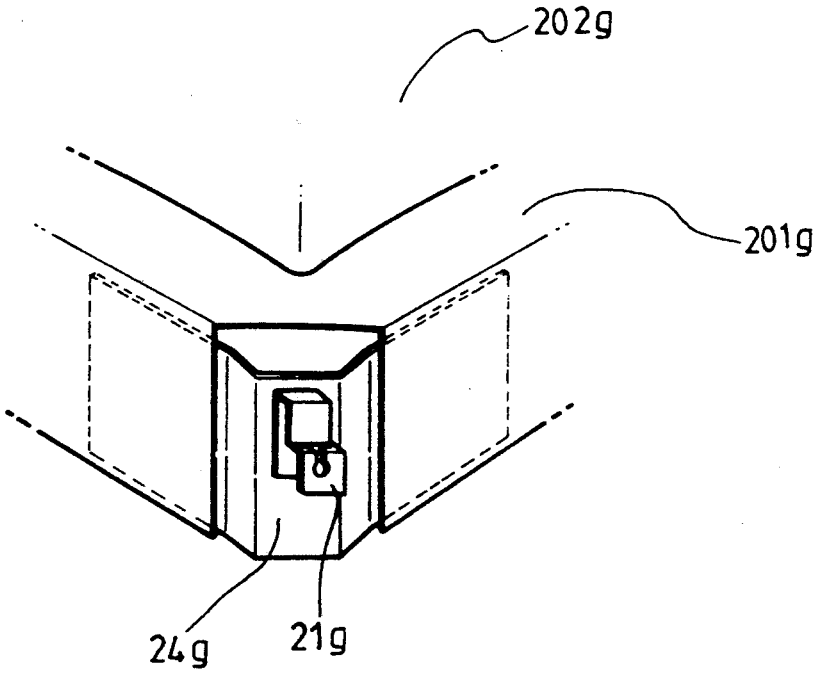
FIGS. 10 is partial, perspective, schematic view of the shadow mask supporting structures of the present invention wherein plate springs are affixed to the corner portion of the shadow mask frame.

It is noted that plate springs 21*g* may be mounted about the centers of the sides of frame 201*g* of shadow mask 202*g*, rather than at the four corners. If it is desired that plate springs 21*g* be attached to the corners, L-shaped fixing plates 24*g* may be used to indirectly connect plate springs 21*g* to the corners of shadow mask 202*g* as shown in FIG. 10. Two perpendicular faces of fixing plates 24*g* may be placed such that they contact the inner faces of frame 201*g*. The structure is such that, if pulling force is applied to plate spring 21*g*, this force is then transferred via fixing plates 24*g* to frame 201*g* and to shadow mask 202*g*.

Figure 11:
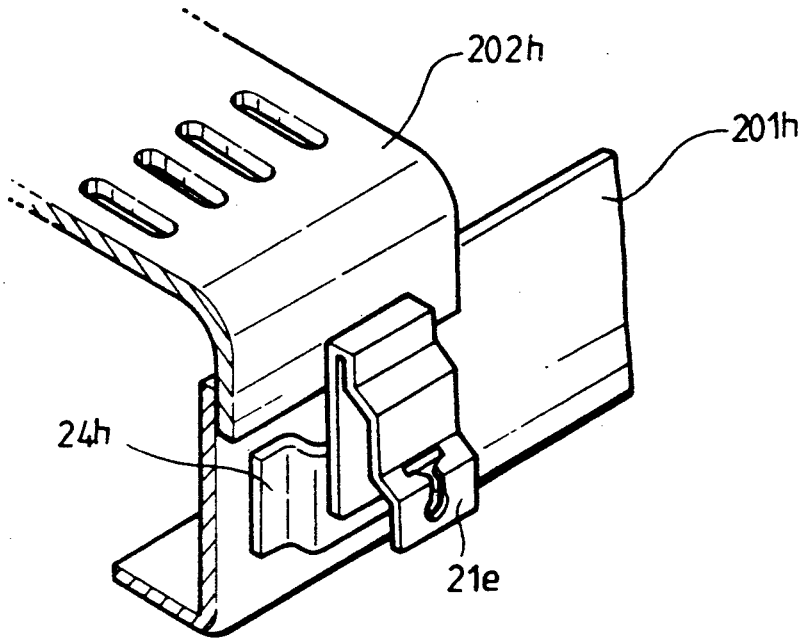
FIG. 11 is partial, perspective, schematic view of the shadow mask supporting structures of the present invention wherein plate springs are affixed to the side portion of the shadow mask frame.

Different types of fixing plates may be used to mount plate spring 21*e*. For example, fixing plate 24*h* of FIG. 11 may be used. In the figure, fixing plate 24*h* is welded to frame 201*h* supporting shadow mask 202*h*. In this configuration, the frame 201*h* is pulled outwards by plate spring 21*e* and shadow mask 202*h* is in turn pulled outwards by its frame 201*h*.

Figure 12:
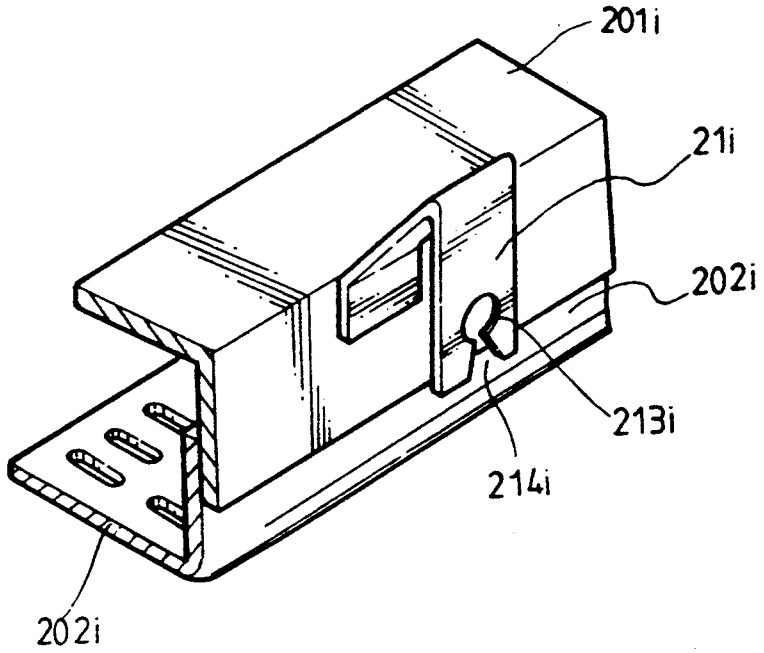
FIG. 12 is a partial perspective, schematic view of the shadow mask supporting structure having a plate spring according to yet another embodiment of the present invention.
Figure 13:
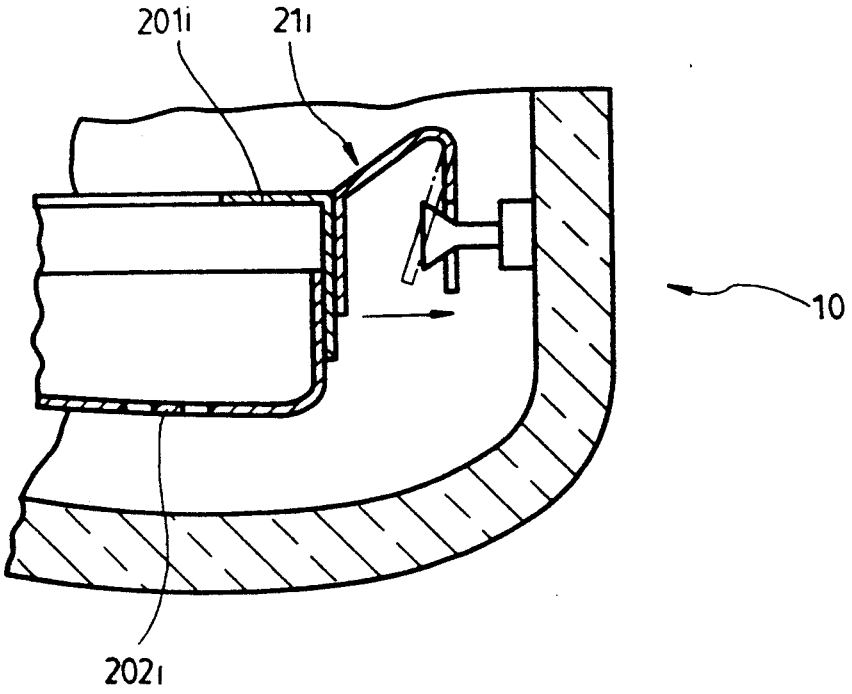
FIG. 13 is a partial, cross-sectional view of a shadow mask supporting structure having the plate spring shown in FIG. 12 wherein shadow mask structure is assembled with the panel.

FIG. 12 shows another embodiment of the present invention. In the figure, plate spring 21*i* faces away from shadow mask 202*i* and toward frame 201*i*. Locked position of plate spring 21*i* is shown in FIG. 13. The plate spring 21*i* is hooked to the head of stud by way of a opening 214*i* and locking hole 213*i*.

In all of the above embodiments, plate springs are mounted either on the sides of shadow mask (or its frames) or the corners. The plate springs may be attached directly or indirectly via accessories such as fixing plates. In any case, the plates springs are used to apply pulling forces on the mounted shadow mask as shown by the direction of the arrows in FIGS. 6, 8, 9 and 13.

Shadow masks in general distort less under pulling forces than under compression forces for equal magnitude. Thus, the mounting apparatus of the present invention deforms shadow masks less than the conventional mounts.

Although only a few embodiments of this invention have been described in detail above, those skilled in the art will readily appreciate that many modifications are possible in the preferred embodiments without materially departing from the novel teachings and advantages of this invention. For example, coil springs may be used in place of the plate springs. Accordingly, all such modifications are intended to be included within the scope of this invention as defined by the following claims.

I claim:

1. In a color cathode-ray tube panel, an apparatus for supporting a shadow mask comprising:

a shadow mask frame;

a show mask disposed on said shadow mask frame;

a plurality of supports for supporting said shadow mask frame, each support being fixedly attached to the color cathode ray tube panel; and a plurality of elastic biases, each bias having a first connecting portion and a second connecting portion, each of the first connecting portions being attached to said shadow mask frame and each of the second connection portions being engaged with a respective one of said plurality of supports so that said biases apply pulling forces to the shadow mask.

2. An apparatus for supporting a shadow mask as in claim 1, in which each of said elastic biases includes a plate spring having a first plate and a second plate connected with the first plate, the first plate being welded to said shadow mask and the second plate being provided with a frame aperture, and in which each of said supports includes a stud having a head and a neck portion wherein a diameter of the head is larger than a diameter of the neck portion, the head being inserted in the aperture of the second plate to form a locking connection between the stud and the second plate.

3. An apparatus for supporting a shadow mask as in claim 2, in which the second plate has a stepped profile of said plate spring which is shaped in a staircase configuration, and in which the aperture is formed in the step which is farthest from the first plate.

4. An apparatus for supporting a shadow mask as in claim 2, wherein each of the studs includes a conically shaped head.

5. An apparatus for supporting a shadow mask as in claim 2, wherein the head of each of said supports is flatly shaped, making a step configuration with the neck portion.

6. An apparatus for supporting a shadow mask as in claim 1, wherein each of said supports includes a conically shaped head and a neck portion.

7. An apparatus for supporting a shadow mask in claim 1, wherein each of said elastic biases comprises:

a fixing plate connected to said shadow mask frame; and a plate spring having first and second plates, the first plate being welded to the fixing plate and the second plate being engaged with a respective one of said supports.

8. An apparatus for supporting a shadow mask as in claim 1, wherein each of said elastic biases comprises:

a fixing plate connected at corners of the shadow mask; and a plate spring having first and second plates, the first plate being welded to the fixing plate and the second plate being connected to a respective one of said plurality of supports.

* * * * *